US005647492A

United States Patent [19]

Fillios et al.

[11] Patent Number: 5,647,492

[45] Date of Patent: Jul. 15, 1997

[54] MOVEMENT RESISTANT ANGLED CLOTHES HANGER ROD STRUCTURE

[76] Inventors: Augustus Fillios, 29 Nova Ct., Brooklyn, N.Y. 11229; Walter Koneke, 15 Buffin La., Blue Point, N.Y. 11715; Hans Koneke, 6701 N. 16th St., Apt. 216, Phoenix, Ariz. 85016; George Fillios, 2496 Natta Blvd., Bellmore, N.Y. 11710

[21] Appl. No.: 642,210

[22] Filed: May 6, 1996

Related U.S. Application Data

[63] Continuation of Ser. No. 363,974, Dec. 23, 1994, abandoned, which is a continuation-in-part of Ser. No. 139,519, Oct. 20, 1993, abandoned.

[51] Int. Cl.[6] ..... A47F 5/00

[52] U.S. Cl. ..... 211/123; 211/105.1

[58] Field of Search ..... 211/105.1, 123; 248/251, 300, 340

[56] References Cited

U.S. PATENT DOCUMENTS

| | | | |
|---|---|---|---|
| 1,673,730 | 6/1928 | Bartels | 190/13 R |
| 2,056,544 | 10/1936 | Vanderveld | 211/182 X |
| 2,401,148 | 5/1946 | Gaffney | 211/124 |
| 2,929,514 | 3/1960 | Stewart | 211/123 |
| 3,013,644 | 12/1961 | Smith et al. | 52/665 |
| 3,302,800 | 2/1967 | Zdanowski | 211/123 |
| 3,435,957 | 4/1969 | Lloyd | 211/123 X |
| 3,991,884 | 11/1976 | DeMaagd et al. | 211/123 X |
| 4,361,241 | 11/1982 | Stoddard | 211/123 |
| 5,121,844 | 6/1992 | Ball | 211/124 |
| 5,129,491 | 7/1992 | Seidman | 190/13 R X |

*Primary Examiner*—Robert W. Gibson, Jr.
*Attorney, Agent, or Firm*—Alfred Walker

[57] ABSTRACT

A space-saving clothes hanger rod structure is provided which holds clothes hangers, and clothes hanging thereon, in an optimal angled position within a closet. There is provided a generally V-shaped rod, when viewed in cross-section, including two upwardly extending members extending at an angle up from a common base point, defining a V-shaped gap therebetween. Both of the upwardly extending members contain at their respective outer, spaced apart edges a plurality of respective longitudinally spaced slot-like channels, each channel being adapted to receive a portion of the arcuate surface of a hanger hook, so that the respective hanger hooks ares held in place at two spaced apart points along the arcuate surface of the hook. As a result, the respective hanger hooks are prevented from moving and rotating off of the angle of the channel, preferably about 50°. Therefore, clothes may be hung within a closet having a minimal depth therein.

1 Claim, 5 Drawing Sheets

FIG. 2
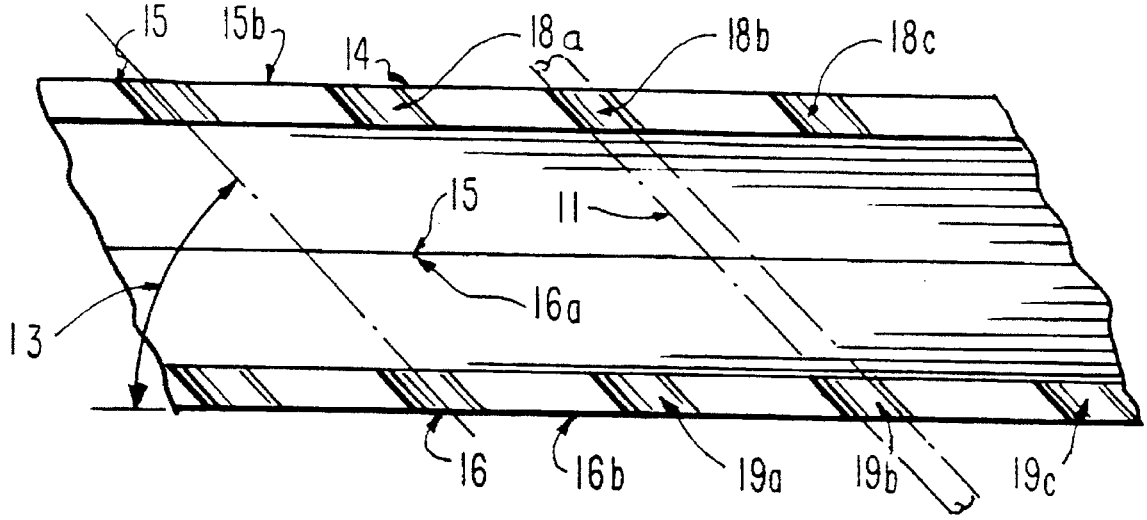
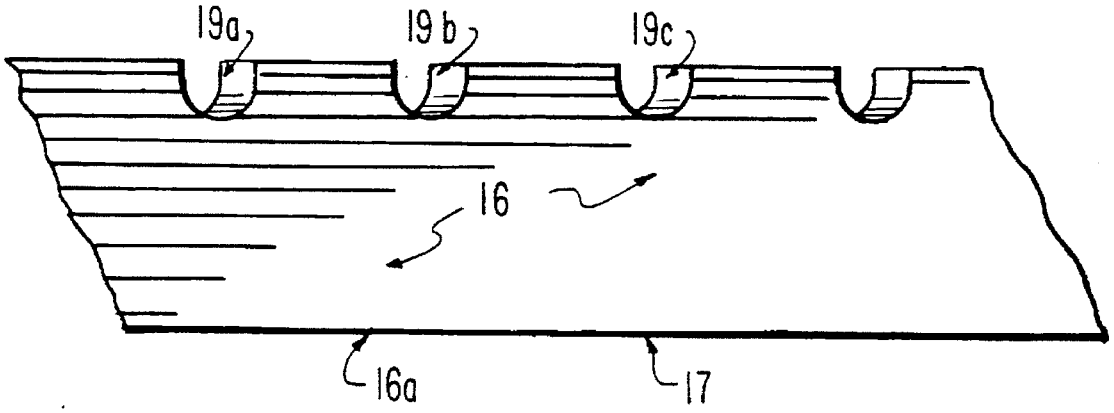
FIG. 3

MOVEMENT RESISTANT ANGLED CLOTHES HANGER ROD STRUCTURE

This application is a continuation of application Ser. No. 08/363,974, filed Dec. 23, 1994, now abandoned, which is a continuation-in-part of application Ser. No. 08/139,519, filed Oct. 20, 1993, now abandoned.

FIELD OF THE INVENTION

The present invention relates to a space-saving clothes hanger rod structure which holds clothes hangers, and clothes hanging thereon, in an optimal angled position within a closet. More particularly, the present invention includes a mobile closet assembly which includes a generally V-shaped rod in cross-section, including two upwardly extending members extending at an angle up from a common base point. Each of the upwardly extending members contains a plurality of respective longitudinally spaced slot-like channels, each channel being adapted to receive a portion of the arcuate surface of a hanger hook, so that the hook is held in place at two spaced apart points along the arcuate surface of the hook. As a result, the hook is prevented from moving and rotating off of the angle of the channel, preferably 50°. While the slot-like channels limit the movement of the hangers, the slot-like channels also permit unrestricted removal of each of the hangers.

BACKGROUND OF THE INVENTION

Various attempts have been made to minimize use of space in a clothes hanger environment, such as a closet. Among these patents are:

| Patent Number | Inventor | Date |
|---|---|---|
| 1,613,447 | Ellberg | Jan. 4, 1927 |
| 3,991,884 | DeMaagd et al. | Nov. 16, 1976 |
| 4,361,241 | Stoddard | Nov. 30, 1982 |
| 4,548,328 | Brauning | Oct. 22, 1985 |

These prior art patents disclose garment hanger racks wherein slots are provided in the rack configured to accommodate the hook on a typical garment hanger and support the garment in an angular relationship with respect to the longitudinal axis of the rack. Such an arrangement provides for improved display of the garments arranged on the rack and, in addition, requires a lesser depth if the rack is positioned in a closet.

The patent to Zdanowski, U.S. Pat. No. 3,302,800 shows a hanger bar which in the configuration of FIG. 9 therein consists of a V-shaped element with slots on the top to accommodate clothes hangers. The slots on the top are not staggered as called for in the present invention. Also the tops of the sides of the V-shaped elements in Zdanowski are bent inward, thus providing an obstacle to the unrestricted removal of a hanger therefrom. The bent protrusions of Zdanowski extend substantially over the opening of the V-shaped slots, thereby presenting cantilevered flanged obstacles which interfere with the free removal of hangers therefrom.

The patent to DeMaagd, U.S. Pat. No. 3,991,884, represents a showing of this concept, wherein a clothes hanger rod 10 has angled notches 20 to accommodate clothes hanger hooks 26.

U.S. Pat. No. 4,361,241 to Stoddard, describes a carpet sample display rod 21 wherein rounded projections 32 project up from the rod 21 to define parallel recesses 34 for the hanger hooks 26.

The patent to Stewart on U.S. Pat. No. 2,929,514 describes a vertically oriented clothes hanger bar with a plurality of U-shaped grooves and a second horizontally oriented bar with further V-shaped grooves, which second bar is movable relative to the first bar to move the hangers thereon to an angled position.

The patent to Smith U.S. Pat. No. 3,013,644 discloses a V-shaped bar in a non-analogous art for a ceiling structure. The V-shaped bar contains no slots for hangers, and contains bent, cantilevered protrusions extending inward from the tops of the upwardly extending members of the V-shaped bar.

The patent to Lloyd U.S. Pat. No. 3,435,957 describes an auxiliary clothes hanger structure attached to an ironing board. The structure includes a U-shaped bar with a plurality of V-shaped slots extending only into the two slightly top edges of the U-shaped bar. The V-shaped slots are not angled with respect the axis of the U-shaped bar.

U.S. Pat. No. 1,613,447 to Ellberg describes a suspension device for clothes wherein descending hooks 10 may be rotated at an angle.

However, none of the prior art patents disclose a device which holds a clothes hanger hook in two places, to limit movement of the hook off of a preferred storage angle.

The distinguishing feature of the present invention from the prior art includes the novel "V"-shaped cross sectional bars, which permit the two slots to stabilize the coat hanger hook in place. The curved slots within the prior art rods of the DeMaagd, Stoddard or Brauning patents cause the hanger hooks to rotate loosely and move away from the desired angle.

Conversely, the bent inwardly extending protrusions of the Zdanowski patent interfere with the smooth, unrestricted removal of the hangers therefrom.

In contrast the two slots of the present invention provide two spaced apart slots to keep the hanger hooks (and the clothes hanging therefrom) resting in place in the desired angle.

OBJECTS OF THE INVENTION

It is an object of the present invention to provide a space-saving clothes hanger rod structure which holds clothes hangers, and clothes hanging thereon, in an optimal angled position within a closet.

It is a further object of the present invention to provide a generally V-shaped rod in cross-section, including two upwardly extending members extending at an angle up from a common base point.

It is yet another object to provide a space savings clothes hanger rod structure with upwardly extending members containing a plurality of respective longitudinally spaced slot-like channels, wherein each channel is adapted to receive a portion of the arcuate surface of a hanger hook.

It is a further object to provide a clothes hanger holder wherein the hook is held in place at two spaced apart points along the arcuate surface of the hook.

It is yet another object to provide a movement resistant clothes hanger rod structure wherein the hangers are prevented from moving and rotating off of the angle of the channel, preferably about 50°.

It is yet another object to provide a mobile closet assembly.

It is yet a further object to provide a clothes hanger rod which permits unrestricted removal of the hangers from the rod.

It is yet a further object of the present invention to provide a movement resistant clothes hanger rod structure which improves over the disadvantages of the prior art.

SUMMARY OF THE INVENTION

The present invention is a structure which minimizes use of space in a clothes hanger environment, such as a closet.

It includes a garment hanger rack wherein slots are provided in the rack configured to accommodate the hook on a typical garment hanger and support the garment in an optional angular relationship with respect to the longitudinal axis of the rack. The present invention therefore provides for improved display of the garments arranged on the rack and, in addition, requires a lesser depth if the rack is positioned in a closet by conventional support brackets.

The clothes hanger rod of the present invention has a plurality of pairs of angled notches to accommodate clothes hanger hooks, while preventing their movement upon the rack.

For example, the clothes display rod of the present invention includes a rod with pairs of parallel angled recesses for each of the hanger hooks.

As a result, there is provided a suspension device for clothes wherein the clothes hangers may be prevented from rotating away from a desired angle within the closet.

The present invention achieves these advantages because it is a device which holds a clothes hanger hook in two places, at each of the pairs of notches, to limit movement of the hook off of the preferred storage angle.

A novel characteristic of the present invention includes the "V"-shaped cross sectional bars, which permit each pair of two slots to stabilize each of the coat hanger hooks in place, by retaining the hooks at two separate points along the inside arcuate surface of each hook.

While permitting unrestricted removal of each of the hangers from the V-shaped bar.

The present invention therefore prevents the hanger hooks from rotating loosely and from moving away from the desired angle, because the two slots of the present invention retain the hooks at the two separate points of the arcuate inside surfaces of the hooks, thereby keeping the hanger hooks (and the clothes hanging therefrom) resting in place in the desired angle.

The present invention may be incorporated into a mobile closet assembly including a free standing and movable closet having a pair of side walls, front and rear walls, a floor, and a top forming an enclosure. The front wall has a door for access to the interior of the closet. A rod is placed within the closet, extending between the side walls for supporting clothes hangers thereon carrying articles of clothing.

The rod has a cross section in the form of a "V", with a corner of the "V" pointed downwardly and the sloping sides being at substantially right angles to each other, and a flat horizontal surface is formed at each of the top edges of each upwardly extending member of the "V" shaped rod joining the two sides of each upwardly extending member.

A groove is formed in the top horizontal surface edge of the V-shaped rod to reduce the depth of the closet required to house clothes without crushing the clothes, and to limit the movement of the hangers when the closet is being moved, and to permit unrestricted removal of each of the hangers.

A plurality of spaced, straight grooves are formed in the top horizontal surface edge of each upwardly extending member at a substantial angle to the longitudinal axis of the V-shaped rod. Each groove supports the hook portion of a hanger so that the clothes on the hangers overlap each other within the closet. The grooves are free of any bent or inwardly protruding members which could interfere with the removal of any clothes hanging therefrom.

The sloping sides of the V-shaped rod extend upwardly at the same angle from the horizontal.

Preferably, the grooves are rectangular in cross section with vertically extending side walls.

The aforesaid objects and advantages of the present invention may be ascertained from the description of the invention in the following drawings.

DESCRIPTION OF THE DRAWINGS

FIG. 2 is a closeup top plan view of the rod portion of the present invention.

FIG. 3 is a closeup side elevational view of the rod portion of the present invention.

DETAILED DESCRIPTION OF THE PREFERRED EMBODIMENT OF THE INVENTION

Figure 1:
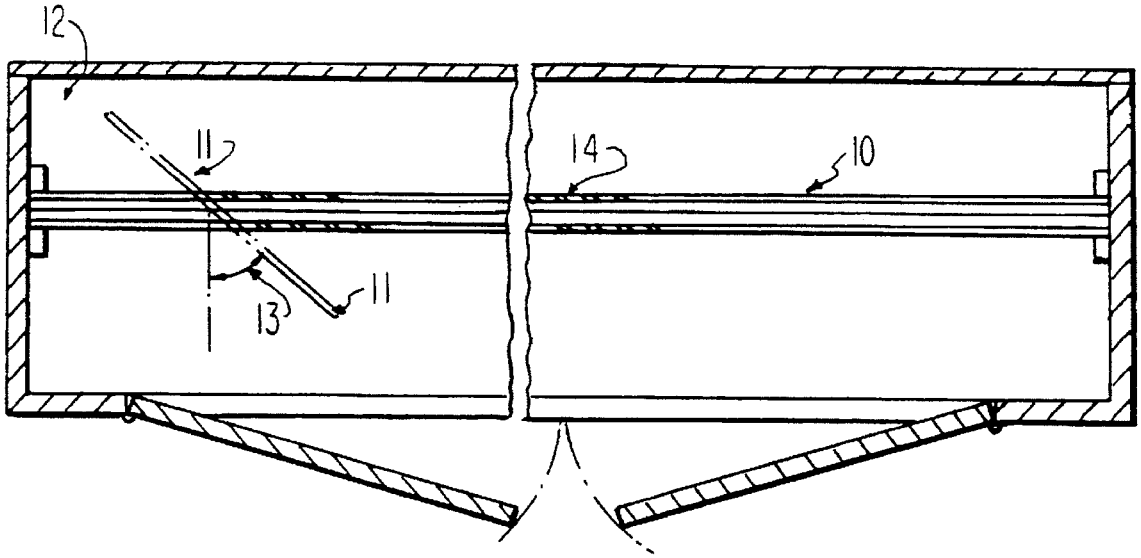
FIG. 1 is a top plan view of the present invention.
Figure 4:
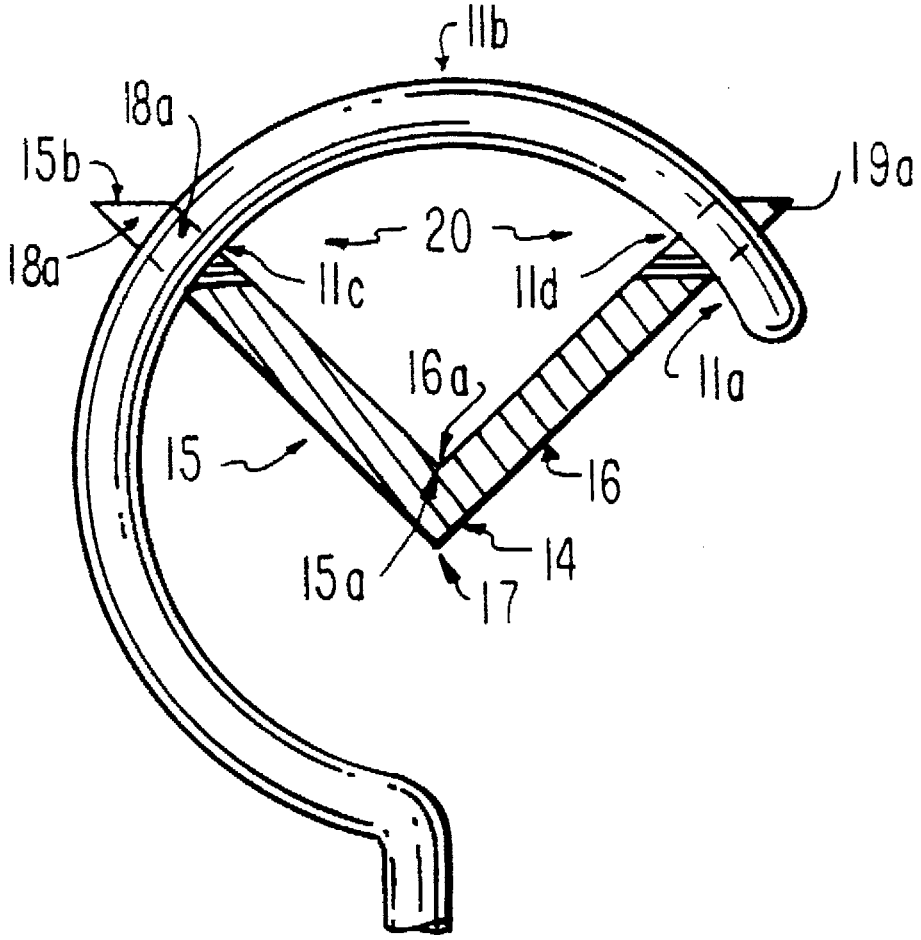
FIG. 4 is an end view in section showing a clothes hanger resting upon the notched rod of the present invention.
Figure 5:
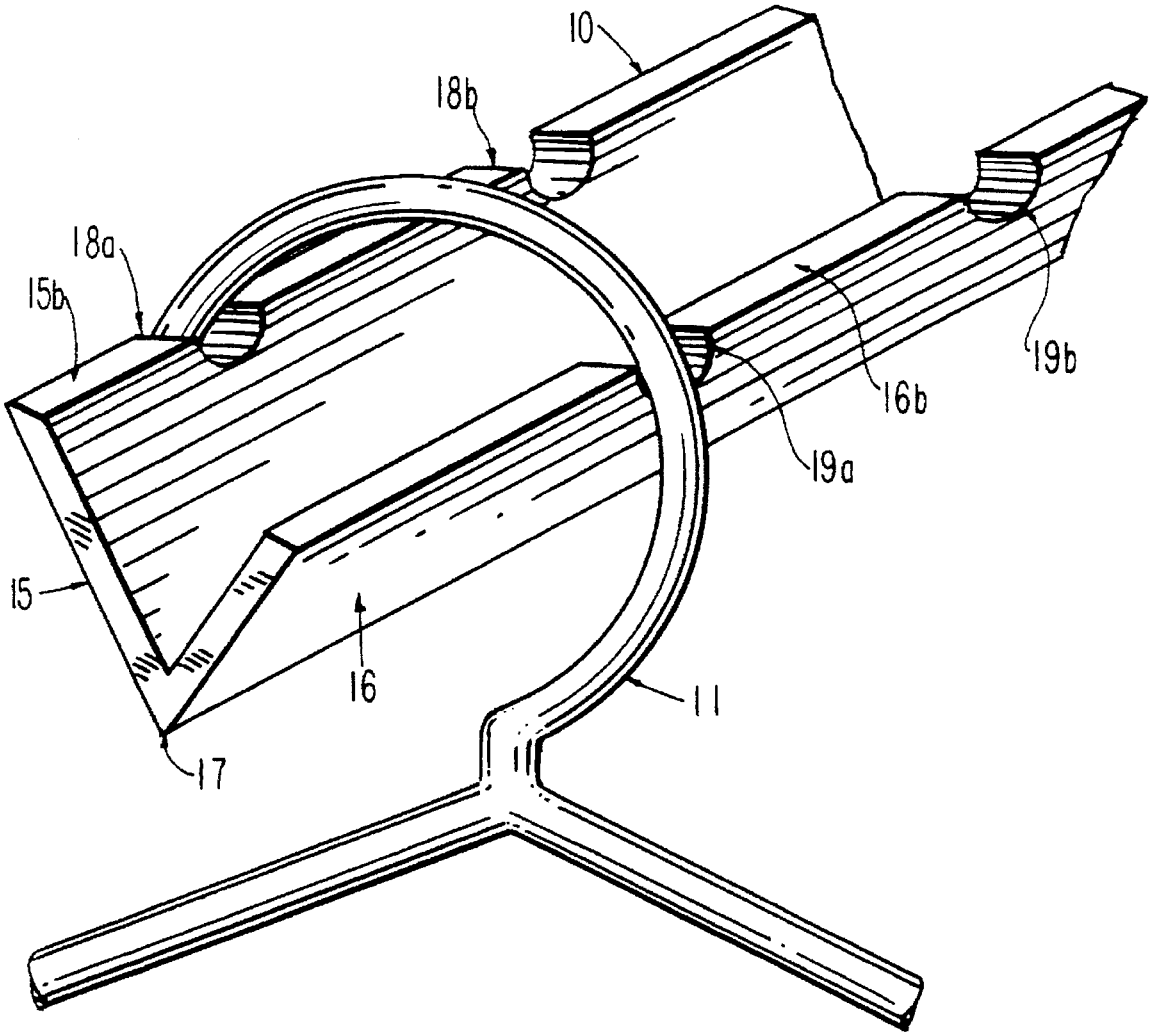
FIG. 5 is a perspective view of the present invention.

As shown in FIGS. 1–5, there is shown a movement resistant, space-saving clothes hanger rod structure 10, which holds a plurality of conventional clothes hangers 11, and clothes hanging thereon, at an optimal angled position within a closet 12 at an angle designated as reference numeral 13.

More particularly, the longitudinally extending rod structure 10 includes a generally V-shaped rod 14, which rod 14 is V-shaped when viewed in cross-section, including two upwardly extending members 15 and 16 extending at an angle up from a longitudinally extending common base line joint 17 at the bottom edges 15*a* and 16*a* of extending members 15 and 16.

The upwardly extending members extend in a V-shaped configuration, with a V-shaped gap 20 presented therebetween.

Each of the upwardly extending members 15, 16 contains a plurality of respective longitudinally spaced slot-like channels 18*a*, 18*b*, 18*c*, etc. and 19*a*, 19*b*, 19*c* etc., wherein slot-like channels 18*a*, 18*b*, 18*c*, etc. each descend in an indented manner within outer top edge 15*b* of extending member 15, providing respective recesses therein, and further wherein slot-like channels 19*a*, 19*b*, 19*c*, etc. descend in an indented manner within a corresponding outer top edge 16*b* of extending member 16, providing further respective recesses therein.

Each recess of slot-like channels 18*a*, 18*b*, 18*c* etc. and 19*a*, 19*b*, 19*c* etc. is adapted to receive a portion of the arcuate surface 11*a* of a hanger hook 11*b* of hanger 11, so that the hook 11*b* is held in place at two spaced apart points 11*c* and 11*d* along the arcuate inside surface 11*a* of the hanger hook 11*b* of hanger 11.

As also shown in the drawings, upwardly extending members 15, 16 of V shaped rod 1 extend continuously without a break or bend therein. The uppermost edges 15B, 16B of each upwardly extending member 15, 16 are separated from each other at the widest distance therebetween.

As a result, the hook 11*b* of hanger 11 is prevented from moving and rotating off of the angle extending between respective channels 18*a*, 19*a* of the rod 14 and the longitudinal axis of rod 14 preferably 50°.

The rod structure 10 includes the slots 18*a*, 18*b*, 18*c*, etc, and 19*a*, 19*b*, 19*c*, etc. in respective pairs, which each said pair of slots defines an imaginary axially extending line therebetween, and are so configured so that each of the imaginary axially extending lines extending between slot-like channels 18*a*, 19*a* is parallel to each other imaginary axially extending line between other pairs of channel-like slots 18*b*, 19*b*. etc., to accommodate the clothes hanger hook 11*b* on a typical garment hanger 11, for supporting a garment in an angular relationship with respect to the longitudinal axis of the V-shaped rod 14.

Such an arrangement provides for improved display of the garments arranged on the V-shaped rod 14 and, in addition, requires a lesser depth if the V-shaped rod 14 is positioned in the closet 12.

The present invention is therefore a structure which minimizes use of space in a clothes hanger environment, such as in closet 12.

Consequently, the garment hanger rod 14 having upward extending members 15 and 16 wherein slot-like channels are provided in the rod 14, accommodates the hook 11*b* on a typical garment hanger 11 and supports the garment in an optimal angular relationship with respect to the longitudinal axis of the rod 14.

The structure 10 of the present invention therefore provides for improved display of the garments arranged on the rod 4 and, in addition, requires a lesser depth if the rod 14 is positioned in the closet 12.

The clothes hanger rod 14 of the present invention with the plurality of pairs of angled notched slot-like channels 18*a*, 18*b*, 18*c*. etc., 19*a*, 19*b*, 19*c*, etc., prevents and limits the movement of hangers upon the V-shaped rod 14.

As a result, there is provided a suspension device for clothes wherein the clothes hangers 11 may be prevented from rotating away from the desired angle 13 within the closet 12. This occurs because, unlie the prior art devices which provide one recess for each hanger, in the rod structure 10 of the present invention each hanger hook 11*b* is held in place at two places along its inside arcuate surface, namely at points 11*c* and 11*d*, which points 11*c* and 11*d* are located spaced apart from each other along the inside surface 11*a* of hanger hook 11*b* of hanger 11.

For example, the device of the present invention holds a typical clothes hanger hook 11 in two places 11*c* and 11*d* of hanger 11, at each of the pairs of notched hook-like channels 18*a*, 19*a*, etc., to limit movement of the hanger 11 off of the preferred storage angle 12 as aforesaid.

The supporting upwarding extending members 15 and 16 for the clothes hangers 12 extend upward off a common longitudinal axis joint 17 at lower edges 15*a* and 16*a* to provide the aforementioned V-shaped channel 20 between two upwardly extending members 15 and 16.

The angled slots-like channels 18*a*, 19*a*, etc., which are presented in a pair for each clothes hanger hook 11*b*, stabilize the coat hanger hook 11*b* in place. The present invention therefore prevents the clothes hangers 11 from rotating loosely and from moving away from the desired angle 13, because each of the pairs of slot-like channels 18*a*, 19*a* of the hanger structure 10 of the present invention retain the clothes hanger hooks 11*b* positioned in place at the desired angle 13, preferably about 50 degrees.

Figure 6:
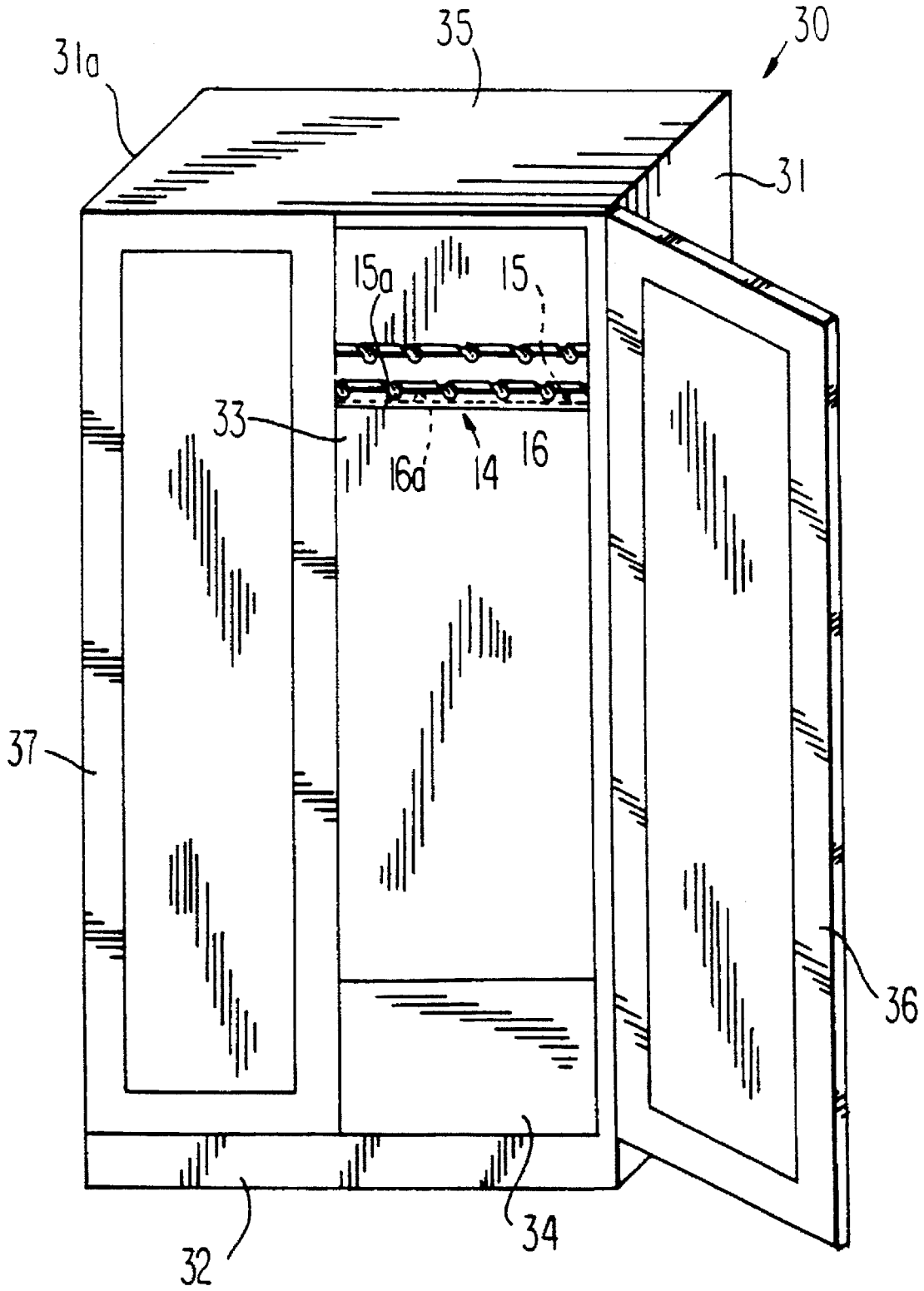
FIG. 6 is a perspective view of an alternate mobile closet assembly in accordance with the present invention.

As shown in FIG. 6, an alternate embodiment includes a mobile closet assembly 30 which is free standing and movable. Mobile closet 30 includes a pair of side walls 31, front wall 32 and rear wall 33, a floor 34, and a top 35 forming an enclosure. Front wall 32 includes doors 36, 37 for access to the interior of closet 30, which closet 30 includes rod structure 10, as shown in FIGS. 1–5. V-shaped rod 14 extends within closet 30 between side walls 31, 31*a* for supporting clothes hangers 11 thereon carrying articles of clothing. V-shaped rod 14 may also be an L shaped rod with unequal sides, wherein corner 17 points downward.

V-shaped rod 14 has a cross section in the form of a "V" with a corner 17 of a triangle formed by upwardly extending members 15, 16 pointed downwardly and the sloping sides of members 15, 16 are at substantially right angles to each other. A flat horizontal surface is formed at each of the top edges 15*b*, 16*b* of members 15, 16 of the V-shaped rod. Top edges 15*b*, 16*b* join the inner and outer sides of each of respective upwardly extending members 15, 16.

Groove slots 18*a*, 18*b*, 18*c* etc. of member 15 and grooved slots 19*a*, 19*b*, 19*c* etc of member 16 are formed in the top edges 15*b*, 16*b* of respective upwardly extending members 15, 16 of rod 14 to reduce the depth of closet 30 required to house the clothes without crushing, to limit the movement of hangers 11 when closet 30 is being moved, and permit unrestricted removal of each of the hangers 11.

Groove slots 18*a*, 18*b*, 18*c* etc. and 19*a*, 19*b*, 19*c* etc. comprise a plurality of spaced, straight grooves formed in top edges 15*b*, 16*b* of members 15, 16 at a substantial angle to the longitudinal axis of rod 14. Each groove slot 18*a*, etc. supports the hook portion 11*b* of a hanger 11 so that clothes on hangers 11 overlap each other within closet 30. The grooves 18*a*, 18*b*, 18*c* etc. and 19*a*, 19*b*, 19*c* etc. are free of any protruding members which could interfere with the removal of any clothes hanging therefrom.

Generally sloping sides of upwardly extending members 15, 16 of rod 14 extend upwardly at the same angle from the horizontal.

Preferably grooves slots 18*a*, 18*b*, 18*c*, etc. and 19*a*, 19*b*, 19*c* etc. are rectangular in cross section with vertically extending side walls. Moreover, mobile closet assembly 30 may include V-shaped rod 14 being removable from closet 30.

Groove slots 18*a*, 18*b*, 18*c* or 19*a*, 19*b*, 19*c* may comprise a plurality of spaced, straight grooves formed in each top edge 15*b*, 16*b* at a predetermined substantial angle to the longitudinal axis of V-shaped rod 14.

Groove slots 18*a*, 18*b*, 18*c* on one top edge 15*b* are axially aligned at the predetermined substantial angle with respect to the longitudinal axis of V-shaped rod 14, with grooves 19*a*, 19*b*, 19*c* on the other top horizontal surface 16*b*. Each set 18*a*, 19*a* of aligned grooves 18*a*, 18*b*, 18*c*, etc. and 19*a*, 19*b*, 19*c* etc. support hook portion 11*b* of a hanger 11 so that the clothes on hangers 11 overlap each other within closet 30, wherein grooves slots 18*a*, 18*b*, 18*c* etc. or 19*a*, 19*b*, 19*c* etc. are free of any protruding members which could interfere with the removal of any clothes hanging therefrom.

It is anticipated that other modifications may be made to the details of the device of the present invention, without departing from the scope of the present invention, as noted in the appended claims.

I claim:

1. A movement resistant, space-saving clothes hanger rod structure for supporting clothes hangers, and clothes hanging thereon, in an optimal angled position within a closet, comprising:

an open top, fixed V-shaped horizontally extending rod supporting hangers comprising a pair of upwardly extending side wall members at a predetermined angle from a base joint;

each of the members having a top straight edge parallel to each other in a horizontal plane with a plurality of spaced channels, said channels being arranged in pairs so that each channel in one member is aligned with a channel in the other member in staggered relationship forming a pair of channels in which an axis joining each pair of channels is at a diagonal angle to the parallel top edges of said members, the inside walls of said channels supporting said hangers being parallel to said axis and continuously curved at right angle to said axis;

each hanger mounted on said rod having a hook, said hook resting on a pair of channels so that said hanger rests at a diagonal angle to the length of said rod permitting a plurality of hangers carrying clothing to always overlap so that said closet needs less depth to contain the clothing on hangers.

* * * * *